US008979408B2

(12) United States Patent
Reed

(10) Patent No.: US 8,979,408 B2
(45) Date of Patent: Mar. 17, 2015

(54) METHOD AND APPARATUS FOR APPLYING SOLID PAINT TO SKIN

(71) Applicant: Dead Down Wind, LLC, Pleasant Valley, MO (US)

(72) Inventor: Gary Len Reed, Clinton, MO (US)

(73) Assignee: Dead Down Wind, LLC, Pleasant Valley, MO (US)

( * ) Notice: Subject to any disclaimer, the term of this patent is extended or adjusted under 35 U.S.C. 154(b) by 218 days.

(21) Appl. No.: 13/767,640

(22) Filed: Feb. 14, 2013

(65) Prior Publication Data

US 2013/0344016 A1 Dec. 26, 2013

Related U.S. Application Data

(60) Provisional application No. 61/664,584, filed on Jun. 26, 2012.

(51) Int. Cl.

| | |
|---|---|
| ***B05C 1/00*** | (2006.01) |
| ***A45D 40/26*** | (2006.01) |
| ***A45D 40/04*** | (2006.01) |
| ***A45D 40/24*** | (2006.01) |

(52) U.S. Cl.

CPC ..... *A45D 40/26* (2013.01); *A45D 40/04* (2013.01); *A45D 40/24* (2013.01)

USPC ..... 401/17; 401/19

(58) Field of Classification Search

USPC ..... 401/17–19, 34–37; 206/385, 581; 220/524, 504

See application file for complete search history.

(56) References Cited

U.S. PATENT DOCUMENTS

| | | | | |
|---|---|---|---|---|
| 2,573,828 | A * | 11/1951 | Braselton | 401/31 |
| 5,839,622 | A | 11/1998 | Bicknell et al. | |
| 5,879,096 | A | 3/1999 | Franta et al. | |
| 5,897,262 | A * | 4/1999 | Bratby-Carey | 401/18 |
| 6,210,061 | B1 | 4/2001 | Johnson | |
| 6,345,922 | B2 * | 2/2002 | Tani | 401/32 |
| D635,866 | S | 4/2011 | Smallwood | |

(Continued)

FOREIGN PATENT DOCUMENTS

| | | |
|---|---|---|
| KR | 10-2010-0060066 A | 6/2010 |
| WO | 2010008880 | 1/2010 |

OTHER PUBLICATIONS

International Search Report and Written Opinion dated Aug. 23, 2013 for related PCT Application No. PCT/US2013/040122, filed May 8, 2013; 9 pages.

*Primary Examiner* — Jennifer C Chiang

(74) *Attorney, Agent, or Firm* — Hovey Williams LLP

(57) ABSTRACT

An apparatus for applying solid paint to the skin includes a housing having opposite first and second ends, a first quantity of solid paint in a first receptacle, a second quantity of solid paint in a second receptacle, and an actuator for longitudinally shifting the first receptacle relative to the housing. A pusher may be operatively coupled to the actuator and include a threaded shaft and a first receiver configured for removably mounting the first receptacle. The pusher and the first receptacle mounted therein may move longitudinally relative to the housing corresponding to relative rotational movement of the actuator. The first and second receptacles may be removably mounted in the apparatus whereby the receptacles and the quantities of solid paint contained therein may be removed and replaced without the need for tools. The first and second receptacles may be sized and configured so that their positions may be alternated.

20 Claims, 5 Drawing Sheets

(56) References Cited

U.S. PATENT DOCUMENTS

| | | | | |
|---|---|---|---|---|
| 8,225,955 | B2 * | 7/2012 | Moskow et al. | 220/524 |
| 8,240,930 | B2 * | 8/2012 | Oshri | 401/19 |
| 2002/0071707 | A1 | 6/2002 | Breidenbach et al. | |
| 2006/0165470 | A1 * | 7/2006 | Gerules | 401/18 |
| 2014/0126948 | A1 * | 5/2014 | Haynes | 401/29 |
| 2014/0134123 | A1 * | 5/2014 | Weeston | 424/65 |

* cited by examiner

METHOD AND APPARATUS FOR APPLYING SOLID PAINT TO SKIN

This application claims the benefit of U.S. Provisional Application No. 61/664,584, filed Jun. 26, 2012, the entire disclosure of which is incorporated herein by reference.

BACKGROUND OF THE INVENTION

1. Field of the Invention

The present invention concerns a method and an apparatus for applying paint in solid form to the skin. More particularly, it is concerned with a method and an apparatus whereby a single dispenser may be provided which holds solid paint at two opposite ends, thereby permitting the user to selectively apply solid paint of different colors or color combinations from a single dispenser.

2. Description of the Prior Art

Solid paint has long been used by performers and others to alter ones visual appearance. By "solid" as used in this application is meant paint which is self-sustaining in shape and still transfer colorant to the skin within the range of temperatures normally encountered in an outdoor environment, e.g. about 0° F. (−18° C.) to 100° F. (38° C.). Paint sticks, sometimes described as "greasepaint", have been used to alter the skin's color, as well as charcoal and burnt cork. The handling of these substances can be messy and thus articles for holding the solid paint have been used.

More recently, hunters and military members have used solid paint to camouflage the skin in an effort to blend into the surroundings. The use of one, or even two different colors may not have satisfactory camouflaging abilities in order to avoid detection by game or an armed enemy. These users have more demanding requirements because the solid paint must often be applied to the skin in multiple colors in the field, and they have limited ability to carry accessory items such as multiple paint dispensers for different colors. U.S. Design Pat. No. 635,866 shows an ornamental design for a paint stick dispenser, but it is believed that substantial improvements to the art in this field are needed. Thus, there has developed a need for an improved paint dispenser to meet the demands of, for example, hunters and military members for a lightweight, portable solid paint dispenser offering enhanced capabilities.

SUMMARY OF THE INVENTION

These and other objects have largely been met by the method and apparatus of the present invention. That is to say, the method and apparatus for applying solid paint to the skin avoids the need for the user to hold a plurality or multiplicity of separate articles for each separate color to be used, and is especially handy for use in one or the other hand to reach different skin areas.

The apparatus of the present invention includes a housing having a long axis, with removable caps on each end. A first paint receptacle holding a first quantity of solid paint is oriented to extend away from the housing at a first end, and a second paint receptacle containing a second quantity of solid paint, preferably of a different color than the first quantity of solid paint extends away from the first quantity at a second end of the housing. Preferably, the first receptacle is coupled to the housing for reciprocal motion along the long axis relative to the housing upon manual manipulation of an actuator. Thus, the amount of the first quantity of solid paint exposed beyond a first rim can be manually controlled by the user. The second receptacle may be mounted in a fixed relationship to the housing, but also may be removably mounted without damaging the housing whereby a replacement receptacle can be substituted to replenish the apparatus when the second quantity of solid paint is exhausted or to substitute a different color of the second quantity of solid paint. Similarly, the first receptacle may be configured similar to the second receptacle whereby the first receptacle may be either fixedly mounted to a receiver on the actuator within the housing or removably mounted to the receiver of the actuator within the housing. Most preferably, the first and second receptacles are of the same configuration, permitting installation and use of the first and second quantities of solid paint at either end of the housing. Caps are preferably provided for covering each end of the housing to prevent undesired exposure of the first and second quantities of solid paint. Preferably, the caps are of a common configuration for mounting on the housing, so that either cap may be coupled to the housing at either end, and most preferably the caps are transparent to permit the user to see the color and/or quantity of paint held by each of the first and second receptacles remaining for use.

The first receptacle may be provided with solid paint components in a plurality or multiplicity of colors, whereby different colors may be applied to the skin simultaneously by engaging the components with and moving them across the skin at the same time. This may enhance the camouflage effect by ensuring that multiple selected colors are applied at the same time in a common pattern without any gaps between the applied colors on the skin.

The second quantity of solid paint positioned at the second end may be of a different color than the color of the first quantity of solid paint, if a single unit, or any of the components thereof. Thus, by simply removing both caps and manipulating the apparatus with one hand, the user may quickly apply different colors in different patterns, and more readily blend different solid paint colors on the skin itself to quickly see and adapt the "as seen" color pattern. Both the first and the second receptacle may be provided of an elastomeric material which is retained in the housing by ribs received in corresponding, complemental grooves in the housing or alternatively a receiver of the actuator within the housing, and is thus removably mounted in the housing to permit replenishment of the either the first quantity of solid paint or the second quantity of solid paint independently of one another with a replacement when the initial first or second solid paint quantity is exhausted or when a different color is to be substituted and used.

The method of the present invention includes the steps of providing an apparatus having a first and a second quantity of solid paint suitable for application to the human skin positioned to extend from a single housing at longitudinally opposite ends of the housing, applying the first quantity of solid paint to human skin, and then reversing the dispenser to apply the second quantity of solid paint to the human's skin. In preferred embodiments, the first quantity of solid paint may be comprised of side-by-side components arranged linearly whereby the application of the first quantity of paint to the skin yields three different colors in a side-by-side application pattern, with the second quantity of paint being of a different color than any of the three components. The method may further include the step of replacing the first or the second quantity of solid paint, for example with a different color of solid paint or solid paint combination, or when the amount of solid paint in the first or second quantity of solid paint is reduced to an amount requiring replenishment.

By the provision of additional colors of solid paint in the housing itself, and in the particularly preferred embodiments where first and/or second quantities of paint are mounted to the housing and held by readily removable and replaceable receptacles, even greater flexibility of color selection by the user is made possible. For example, when the user desires to apply the paint to the skin for camouflage purposes, having 4, 6 or possibly even more solid paint colors readily available allows the apparatus to adapt to different foliage conditions. Different colors or color combinations of the quantities of solid paint will allow the user to select for application the desired colors for blending in with Spring or Fall foliage, for woodland, prairie, marsh or desert environments, for night-time conditions, or other outdoor environments.

The present invention offers a number of practical benefits to both those providing the apparatus for sale and for the user. These benefits include:

- Providing an apparatus which is as much as 30% larger in size than typical dispensers of solid paint, making handling and manipulation of users who may be wearing gloves easier;
- Providing two, four or six different available colors of solid paint mounted to the housing instead of three in some existing dispensers for increased camouflage effect and flexibility of pattern application and blending of colors;
- Providing either two fixed quantities of solid paint or a combination of fixed solid paint and retractable solid paint relative to the housing so as to maximize the amount of paint provided in a useful sized housing or to minimize the weight in the field carried by a hunter which makes long treks into the mountains or other demanding terrain or by a military member engaged in field operations;
- Providing a potential increase of 60% to 100% of a useable amount of solid paint and up to 100% more color options for the user in a single apparatus as compared to existing apparatus;
- Provides removable caps of a common configuration for protecting the user from the solid paint during times of non-desired application whereby the caps are interchangeable;
- Providing a plurality of receptacles with a common configuration and a housing complementally configured to permit removal of the receptacles at each end, thereby reducing manufacturing costs and providing greater flexibility to the user;
- Provides a single apparatus to provide more paint in more colors, thereby reducing the number of articles which must be carried in the field or displayed at retail either on the shelf on in a catalog;
- Providing an apparatus where upon exhaustion of either the first or second quantity of solid paint, a replacement receptacle may be installed in the housing, thereby reducing waste, reducing the environmental impact and providing a more environmentally friendly product; and
- Providing refill and substitution options thereby potentially lowering costs to the user by as much as 50%.

It may be appreciated after considering the foregoing summary of the invention that the selection of the colors and combinations of colors of the solid paint are virtually limitless, and thus the method and apparatus hereof is not limited to use by hunters and military members, but may be used by athletes and fans to indicate school color combinations and affiliations, in the performing arts, and for seasonal holidays such as Halloween. These and other opportunities and objects will be readily appreciated by those skilled in the art with reference to the drawings and detailed description forming a part of this disclosure.

DESCRIPTION OF A PREFERRED EMBODIMENT

Figure 1:
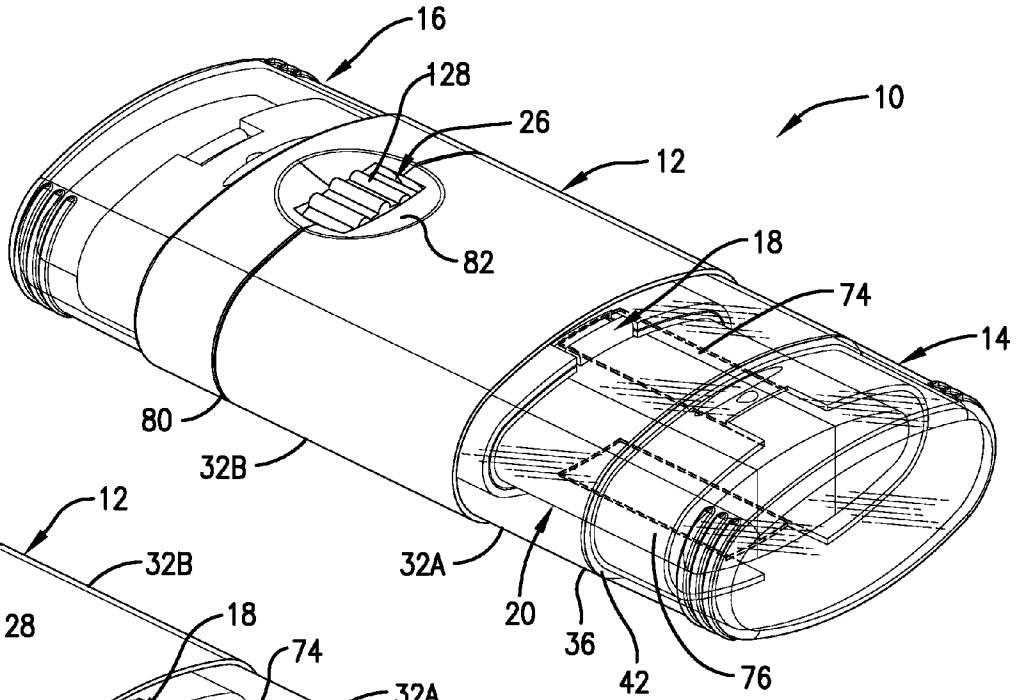
FIG. 1 is an isometric view of an embodiment of the apparatus for applying solid paint to the skin of the present invention showing the caps in place at each end of the housing.

Referring now to the drawing, an apparatus 10 for applying solid paint to human skin is shown in FIGS. 1-8 and broadly includes a housing 12, first and second caps 14 and 16 positioned at respective ends of the housing 10, a first receptacle 18 holding a first quantity of solid paint 20, a second receptacle 22 holding a second quantity of solid paint 24, and an actuator 26 for selectively shifting the first receptacle relative to the housing 12.

Figure 2:
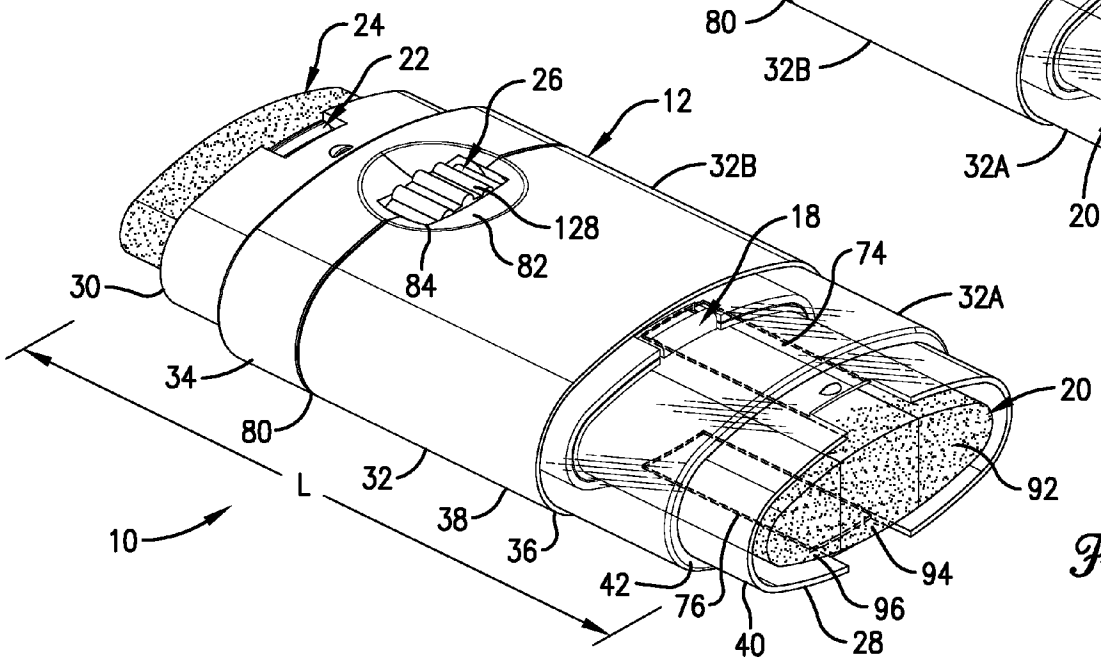
FIG. 2 is an isometric view similar to FIG. 1, but showing the caps removed to reveal the relative position of first and second quantities of solid paint when the first quantity of solid paint is in a retracted position.
Figure 5:
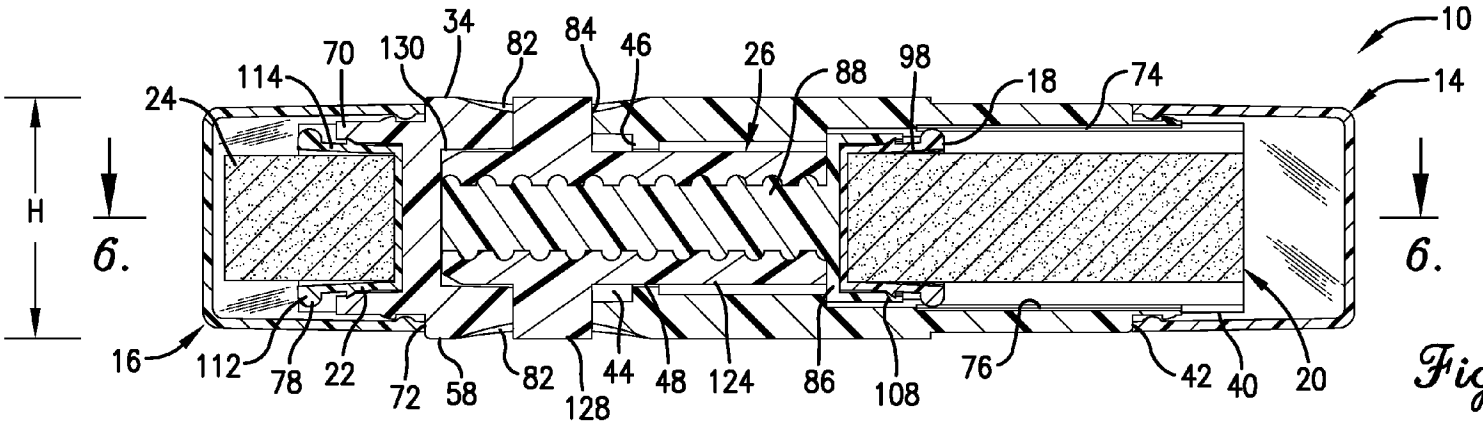
FIG. 5 is a cross-sectional view taken along lines 5-5 of FIG. 4 through the longitudinal axis of the apparatus to show the actuator and the housing with the first receptacle in a retracted position.
Figure 6:
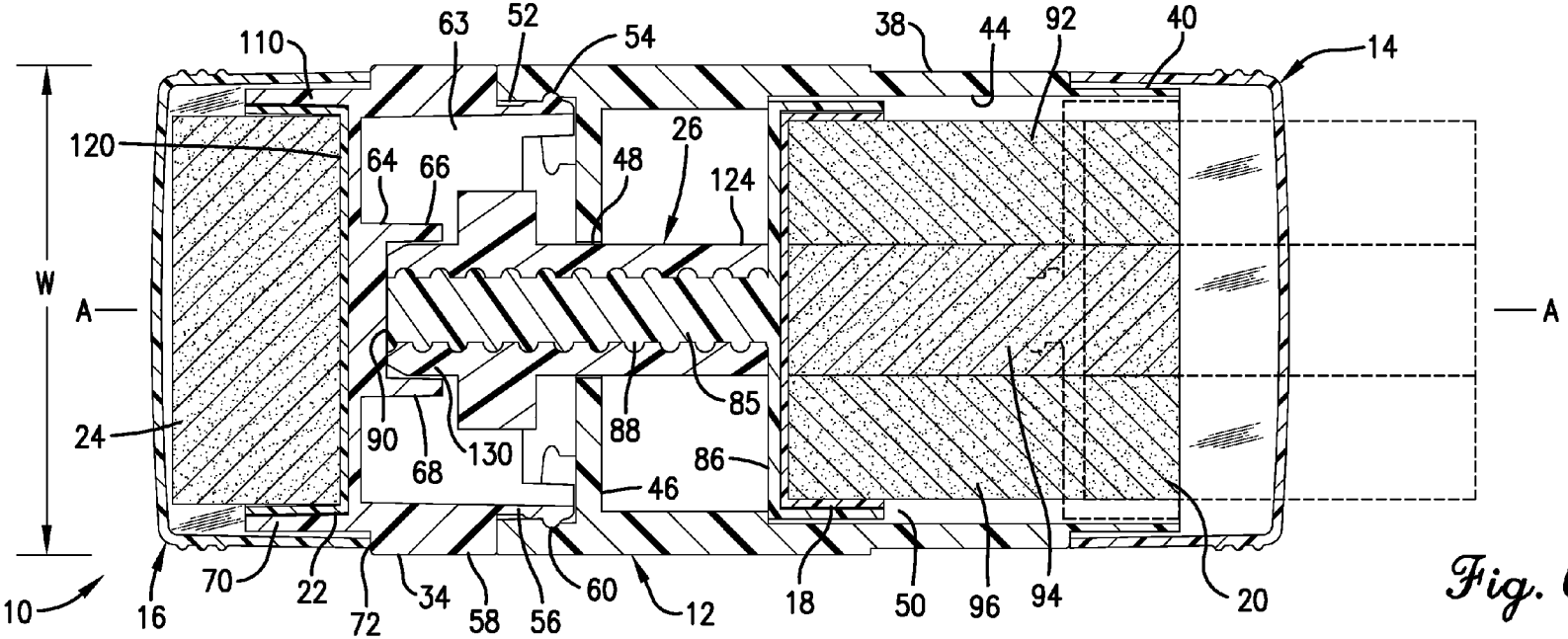
FIG. 6 is a cross-sectional view taken along lines 6-6 of FIG. 5 through the longitudinal axis of the apparatus and rotated 90° relative to the cross-sectional view of FIG. 5 showing the position of the first quantity of solid paint in a retracted position in solid lines and showing the extended position of the first quantity of solid paint when the actuator is rotated to push the first receptacle relative to the housing.

In greater detail, the housing 12 is preferably molded of a substantially rigid synthetic resin material with limited flexibility, such as polyvinylchloride, and has a longitudinally extending axis presenting a first end 28 and a second end 30. The housing 12 is generally oblong when viewed in transverse section, thus having a greater width W than height H, with a length L which is greater than both the width and the height. The housing 12 may preferably include first housing section 32 including the first end 28 and a second housing section 34 including the second end 30. The first housing section 32 has an outer wall 36 presenting an exterior surface 38 with a first neck 40 of a generally reduced dimension to receive thereon first cap 14 which, when fully mounted, abuts first shoulder 42 as seen in FIG. 1. The outer wall 36 of the first housing section 32 also has an interior surface 44 and a transverse wall 46 having a port 48 which may be aligned with the longitudinally extending axis A of the housing. The first housing section 32 may include a remote portion 32A which includes neck 40 which is transparent, and a proximate portion 32B which may be painted to be opaque. A first segment 50 of the interior surface 44 and the transverse wall 46 define a chamber 50 into which the first receptacle 18 is positioned. A second segment 52 of the interior surface 44 distanced farther from the first end 28 than the transverse wall 46 and includes arcuate, partially circumferentially-extending grooves 54. The second housing section 34 is configured to mate with the first housing section 32 by a snap-fit connection. The second housing section 34 thus includes a sleeve 56 which is provided, on its exterior surface 58, with radially extending ribs 60 complementally configured to mate and be received in the grooves 54. A base wall 62 extends transversely across the second housing section 34 to define, with the sleeve 56 and the transverse wall 46, an actuator chamber 63. The base wall 62 may include an actuator guide 64 including a pair of spaced, opposed, arcuate flanges 66 and 68 which help to locate and prevent shifting of the actuator 26. The second housing section 34 may also be provided with a collar 70 which extends away from the base wall 62. The exterior surface 72 of the collar 70 is sized and configured to receive thereon second cap 16 (which is sized the same as first cap 14, at least with respect to its complemental configuration both the first neck 40 and the collar 70) which second cap 16 rests against second shoulder 72 when fully mounted as shown in FIG. 1. The interior surface 44 of the first housing section 32 may include a pair of opposite, longitudinally extending channels 74 and 76 where the outer wall 36 is of a reduced thickness to permit enhanced longitudinal movement of the first receptacle 18 within the chamber 50. The first and second housing sections thus meet along a mating line 80 when viewed externally. As seen in FIGS. 1, 2 and 5, a pair of recesses 82, shown as generally circular is formed in the housing 12 along the mating line 80 of identical configuration are provided on opposite sides of the housing 12. A slot 84 is provided in the recesses 82 through which a portion of the actuator 26 projects, but most preferably the actuator 26 does not project radially beyond the adjacent portions of the first and second housing sections as may be seen in FIG. 5. Thus, the first and second housing sections 32 and 34 adjacent the slot 84 retain the actuator 26 against axial movement when the actuator 26 is rotated about axis A.

Figure 3:
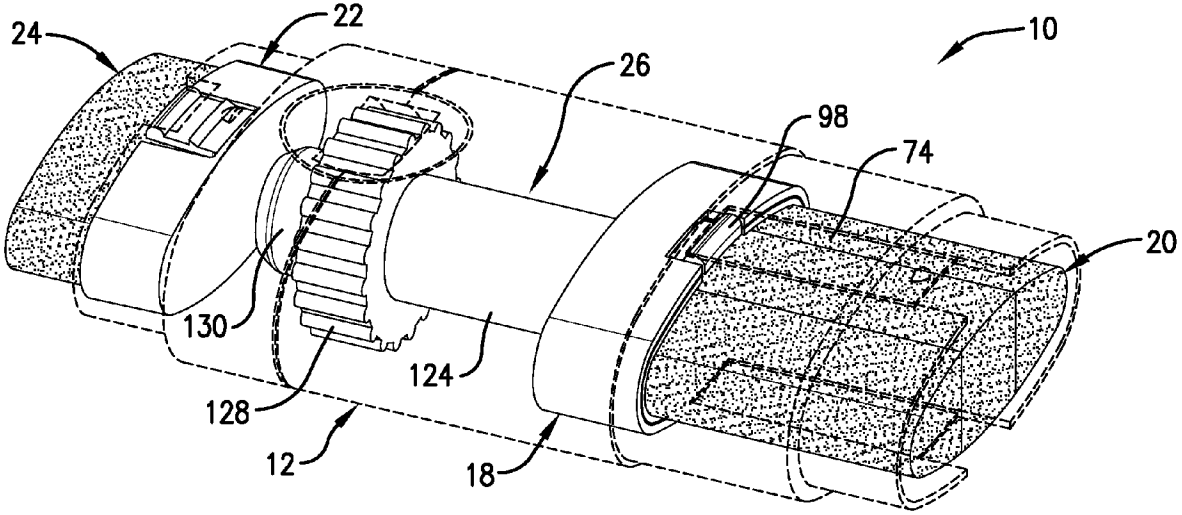
FIG. 3 is an enlarged isometric view of the apparatus hereof, with the housing shown only in broken lines to reveal the axially extending shaft and first receptacle coupled to the actuator for moving the first receptacle and the first quantity of solid paint relative to the housing, and the second receptacle for holding the second quantity of solid paint in fixed relationship to the housing.
Figure 4:
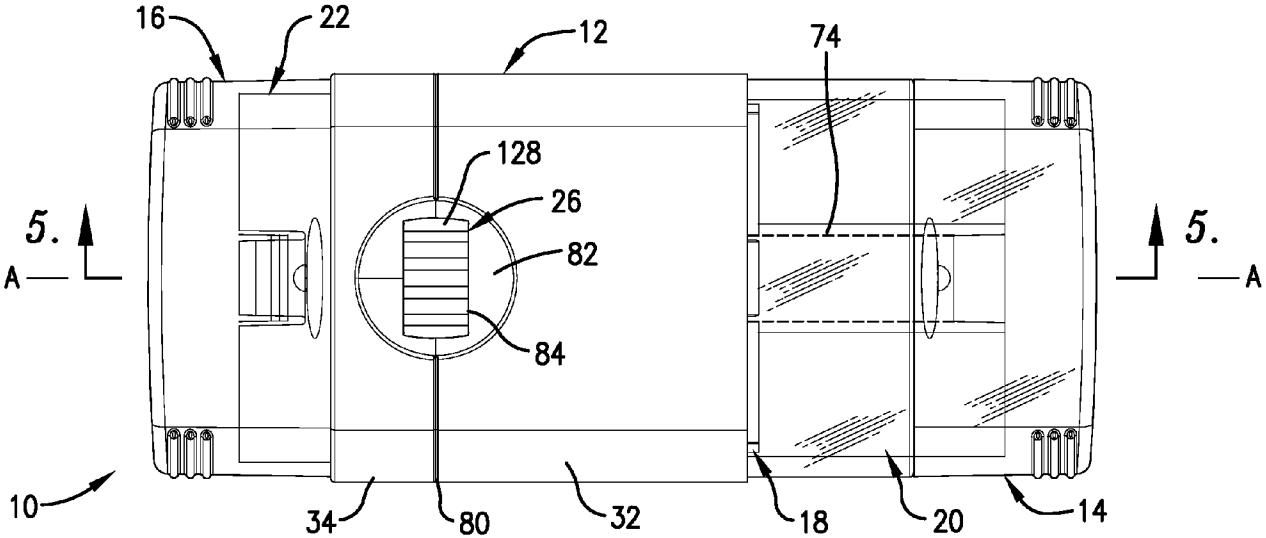
FIG. 4 is an elevational view of the apparatus hereof with the caps in place on either end, similar to FIG. 1.
Figure 7:
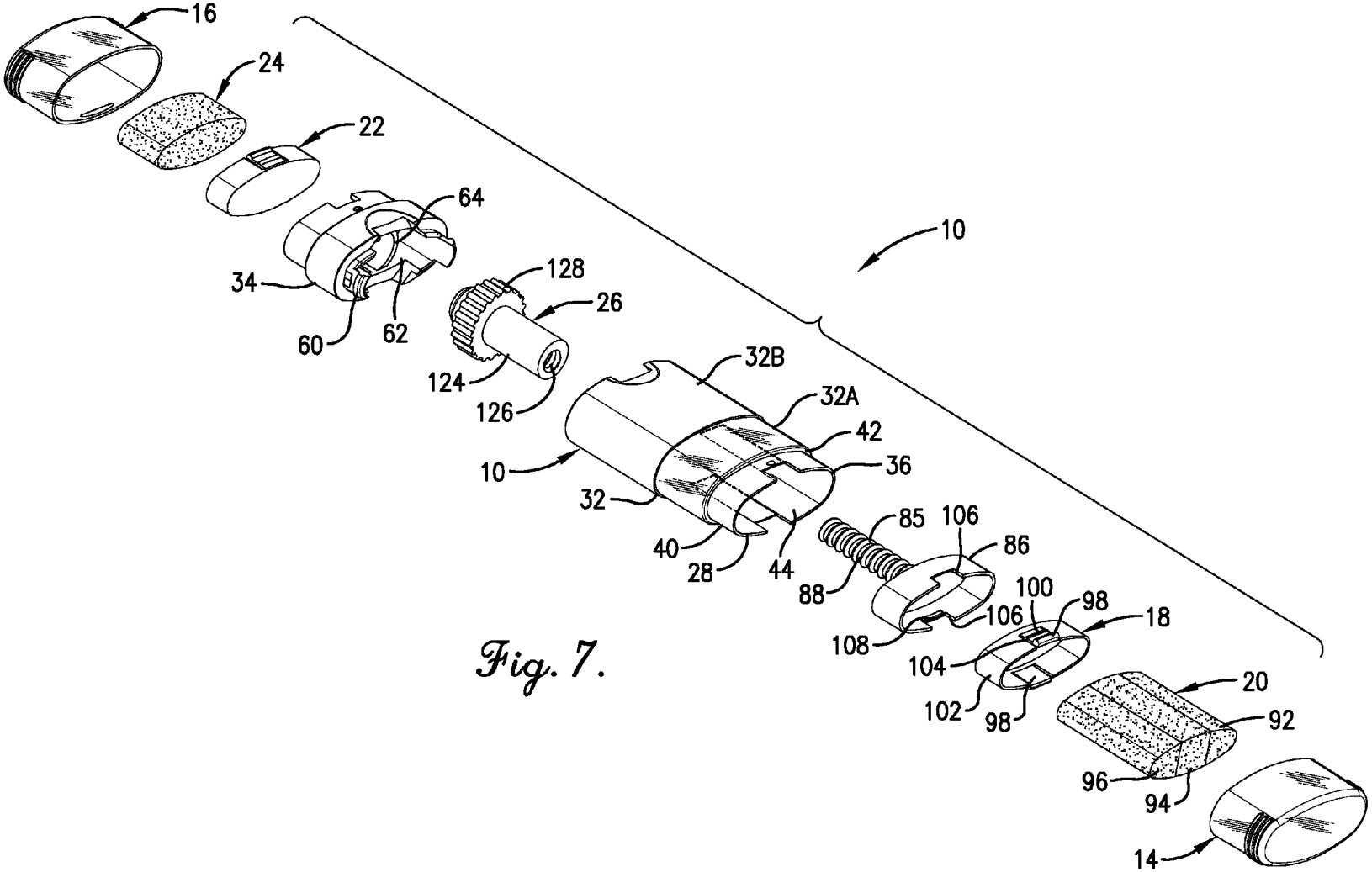
FIG. 7 is an exploded isometric view taken from the right end of the apparatus hereof, showing various components thereof.
Figure 8:
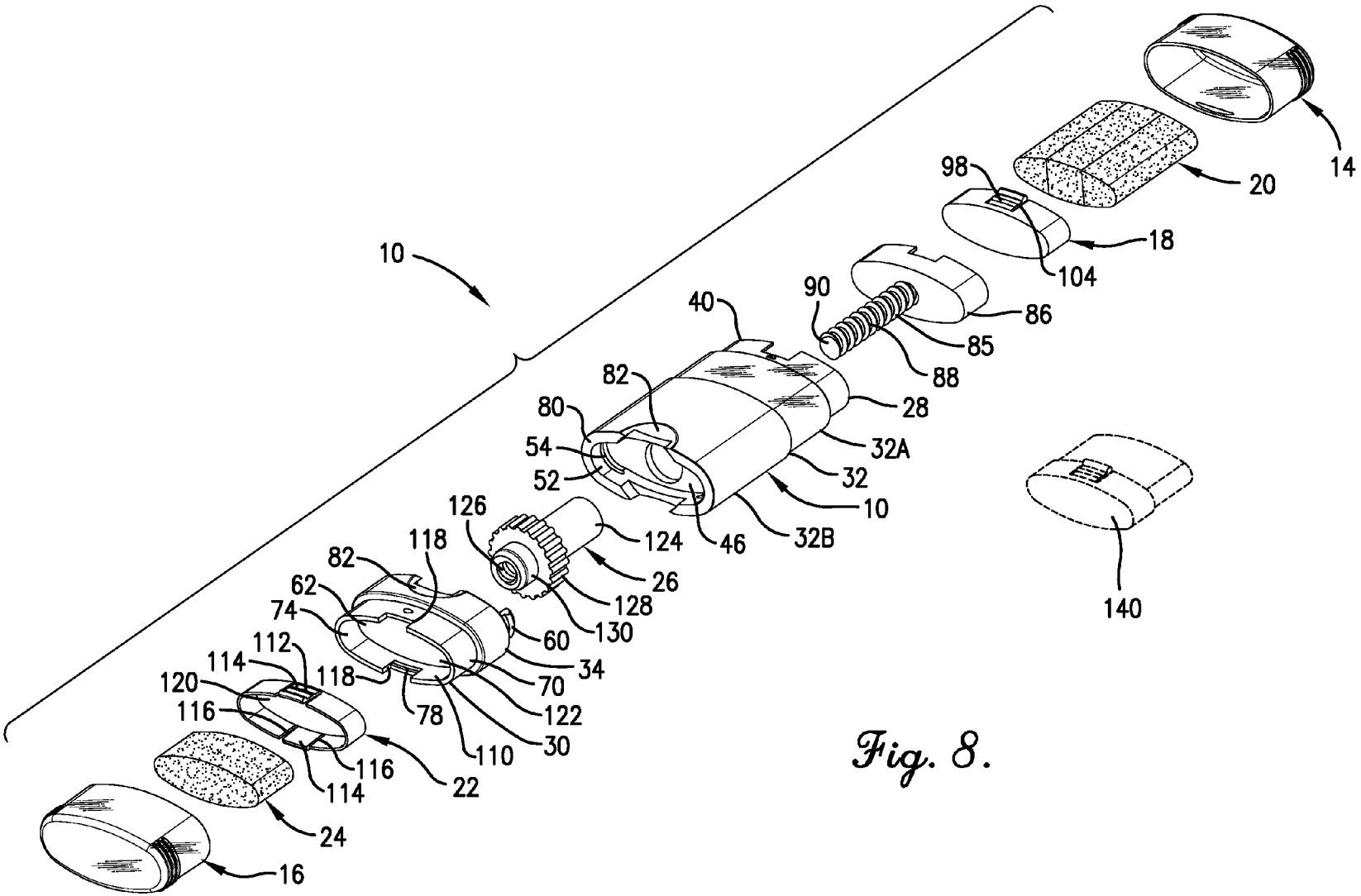
FIG. 8 is an exploded isometric view taken from the left end of the apparatus hereof, showing various components thereof, and further showing a replacement receptacle.

The first receptacle 18 is positioned at or proximate to the first end 28 and may be removably received by a pusher element 85 which includes a cup-shaped first receiver 86 and an elongated, externally threaded shaft 88, which may be molded of synthetic resin such as polyethylene as a unitary member. The shaft 88 extends along axis A and in threaded engagement with the actuator 26. When fully retracted, as shown in FIGS. 2, 3, 5 and 6, the internal end 90 of the shaft may abut or be positioned closely proximate the base wall 62. The shaft 88 thus extends through port 48 when fully retracted as shown. The first receiver 86 is complementally configured with the first receptacle 18 so that the first receptacle may be removably held within the first receiver 86. For example, when the first receptacle 18 is oblong in configuration, as seen in FIGS. 3, 7 and 8, the first receiver 86 is also oblong in configuration and sized to hold the first receptacle 18 which holds the first quantity of solid paint 20. The first quantity of solid paint 20 preferably includes a multiplicity of side-by-side solid paint components 92, 94 and 96, each of a different color. The first receptacle 18 is preferably provided of a resilient, elastomeric material such as natural or synthetic rubber or synthetic resin, and provided with a pair of tabs 98 each having ribs 100 on the outer surface thereof. The tabs 98 may advantageously be part of the first receptacle 18 but to enhance flexibility may be partially separated from a generally circumscribing side wall 102 of the first receptacle 18 by slits 104. The ribs 100 facilitate grasping and serve to hold the first receptacle within corresponding and complementally sized and configured notches 106 provided in the first receiver 86. At least one of the ribs 100 of each of the tabs 98 is preferably complementally sized and positioned to fit into a corresponding groove 108 in the first receptacle 18 just adjacent a respective one of the notches 106.

The second receptacle 22 is positioned at or proximate to the second end 30 and may be positioned and held in a cup-shaped second receiver 110 including the collar 70 and the base wall 62. The second receptacle may also be molded of natural or synthetic rubber or other elastomeric material. The cup shaped-second receptacle 22 is complementally configured with the interior of the collar 70 of the second housing section 24 in snap-fit relationship and includes flexible ribs 112 sized and configured to fit into corresponding grooves 78 in the collar 70. Most preferably, the second receptacle 22 is of the same size and shape as the first receptacle 18 so that the two receptacles 18 may be interchangeably mounted in the respective receivers 86 and 110 without the use of tools. The ribs 112 of the second receptacle 22 may also be provided on flexible tabs 114. The tabs 114 may advantageously be part of the second receptacle 18 but to enhance flexibility may be partially separated from a generally circumscribing side wall 102 of the first receptacle 18 by slits 116. The ribs 112 facilitate grasping and serve to hold the second receptacle 22 within corresponding and complementally sized and configured notches 118 provided in the second receiver 110. The second receptacle 22 may have a base surface 120 which presses against the base wall 62 when inserted into the second receptacle during use. By being fixed rather than shiftable, the second receptacle 22 configured to maximize the second quantity of solid paint 24 within an available space of the housing 12. The second quantity of sold paint 22 is thus held within the cup shaped second receptacle 22 which is in turn located within a second chamber 122 of the housing 12 in order for at least a portion of the solid paint to project beyond the second end 30.

The actuator 26 may be provided as a unitary member molded of synthetic resin such as polyvinylchloride having a longitudinally extending tube 124 having a central internally threaded passageway 126 which receives therein the shaft 88. The actuator may include a ribbed wheel 128 which projects through the slots 84 in the housing 12 but preferably only within the recesses and not radially substantially beyond the exterior surface of the housing 12, as illustrated in FIGS. 1, 3 and 5. The actuator 26 may also include a base socket 130 which fits into the actuator guide 84, with tube 124 extends through the port 48.

The caps 14 and 16 are most preferably transparent, whereby the colors of the first and second quantity of solid paint are revealed without the necessity of removing the caps. In addition or alternatively to providing transparent caps, the first housing section 32 may be entirely transparent or alternatively a transparent portion 32A may be provided.

Use of the apparatus 10 may be readily accomplished by removing one or preferably both caps 14 and 16, then rotating the actuator 26 by finger pressure against the ribbed wheel 128. Because the actuator is fixed against axial movement by the portions of the first and second housing sections adjacent the slots 84 through which the ribbed wheel projects, the engagement of the rotating threaded passageway 106 with the threaded shaft 88 produces axial movement of the first receptacle to push the first quantity of solid paint away from the transverse wall so that more of the first quantity of solid paint is exposed beyond the first end 28.

The provision of channels 74 and 76 enables the actuator to move the first receptacle 18 through the chamber 50 without the ribs 104 engaging the inner surface 44 of the first housing section 32 in such a way that movement is impeded or the first receptacle is dislodged from the first receiver 86. The user then applies the first quantity of solid paint to the human skin (the solid paint as used herein is preferably approved for use on skin, most preferably by a regulatory agency such as the FDA, and may be odorless). When the preferred embodiment is employed with three side-by-side paint components 92, 94 and 96 of three different colors, the application is most effective when the three components contact the skin simultaneously. The user may then apply finger pressure against the ribbed wheel in the opposite direction to retract the first receptacle, manipulate the housing 12 to reverse the positions of the first and second ends, and apply the second quantity of solid paint—preferably of a fourth color, either to a different part of the skin or to blend some of the paint already applied.

The provision of first and second receptacles 18, 22 which can be removed and replaced especially enhances the economy and usability of the apparatus 10 hereof. By configuring the receptacles with flexible tabs and holding ribs, the receptacles are able to be grasped and removed in outdoor environments where the user may be wearing gloves, whereas conventional designs of dispensers require the entire apparatus to be discarded when the applied material is or is nearly spent. The provision of removable and replaceable receptacles has additional advantages not readily apparent—for example, if the first quantity of paint 20, which has a longer longitudinal extent originally, is reduced in longitudinal length, then it can be removed and placed in the second receiver 110. More over, the provision of replaceable receptacles allows the substitution of different colors of solid paint for application. By way of example, if used by a fan of a particular sporting team whose colors are red and blue, a spouse of the fan could replace the red and blue quantities of paint in the first and second receptacles with receptacles (e.g., replacement receptacle 140 of FIG. 8) having black and gold and use the same housing. Another example might be that a hunter in the field could have multiple color combinations and replace different colors or color combinations of solid paint according to season or local environment while still using the same apparatus.

Although preferred forms of the invention have been described above, it is to be recognized that such disclosure is by way of illustration only, and should not be utilized in a limiting sense in interpreting the scope of the present invention. Various modifications may be made within the scope of the teaching of the present invention as set forth herein in view of applicant's disclosure without departing from the spirit of the present invention. For example, it may be appreciated that a second quantity of solid paint also having three side-by-side color components for the second receptacle 22 the same as is illustrated for first quantity of solid paint 20 could be used to provide a second multiplicity of side-by-side solid paint components 92, 94 and 96, and likewise each may be of a different color. Moreover, the surface of the housing and caps may be textured or provided with ribs or other structures to enhance the appearance and ornamental distinctiveness and/or to improve the ability to grip the housing and/or caps.

The inventor hereby states his intent to rely on the Doctrine of Equivalents to determine and assess the reasonably fair scope of his invention as pertains to any apparatus not materially departing from but outside the literal scope of the invention as set out in the following claims.

The invention claimed is:

1. An apparatus for applying solid paint to skin, comprising:

a housing presenting a first end and a second end;

a first receptacle positioned in said housing proximate the first end;

a first quantity of solid paint carried by the first receptacle and extending longitudinally beyond the first end;

an actuator for longitudinally shifting the first receptacle within and relative to the housing;

a second receptacle positioned in said housing proximate the second end; and a second quantity of solid paint carried by the second receptacle and extending longitudinally beyond the second end, wherein the housing includes a first housing section including the first end and a second housing section including the second end connected to the first housing section by a snap-fit connection, wherein the first section of the housing includes a transverse wall having a port therein through which a portion of the actuator passes.

2. An apparatus as set forth in claim 1, wherein the second section of the housing includes a base wall having an actuator guide which receives a portion of the actuator therein.

3. An apparatus as set forth in claim 2, wherein the housing includes at least one slot in an outer wall of the housing and wherein the actuator includes a wheel which projects through said slot.

4. An apparatus as set forth in claim 1, wherein said first receptacle is received in a pusher element operatively connected to said actuator, whereby movement of said actuator relative to said housing produces consequent movement of said pusher element to move said first receptacle and said first quantity of paint longitudinally relative to said housing.

5. An apparatus as set forth in claim 4, wherein said pusher element includes a first receiver complementally configured to receive said first receptacle and a longitudinally extending threaded shaft received by a threaded tube of said actuator, wherein said actuator is mounted within said housing in a manner to permit rotational movement of the actuator relative to the housing while restraining longitudinal movement of the actuator relative to the housing, and whereby rotation of said actuator relative to the housing produces consequent longitudinal movement of the first receptacle.

6. An apparatus as set forth in claim 1, wherein at least a portion of the first housing section is transparent.

7. An apparatus as set forth in claim 1, wherein said first receptacle is removably mounted in a first receiver of a pusher element operatively coupled to said actuator and configured for removal and replacement without the need for tools.

8. An apparatus as set forth in claim 7, wherein said second receptacle is complementally sized and configured for removable mounting without the need for tools in said first receiver in substitution of said first receptacle.

9. An apparatus as set forth in claim 1, wherein said first quantity of paint includes a plurality of side-by-side paint components of different colors.

10. An apparatus as set forth in claim 1, wherein the second receptacle is configured to be removed from the second end of the housing.

11. An apparatus as set forth in claim 1, wherein the first receptacle is configured to be removed from the first end of the housing, and wherein the second receptacle is configured to be removed from the second end of the housing and is further configured to be positioned within the first end of the housing.

12. An apparatus as set forth in claim 1, wherein the housing is configured to receive a replacement receptacle in substitution of at least one of the first receptacle and the second receptacle.

13. An apparatus as set forth in claim 1, wherein each receptacle at least partially encloses its respective quantity of solid paint, and wherein each quantity of solid paint is at least partially unenclosed by its respective receptacle.

14. An apparatus for applying solid paint to skin, comprising:

a housing presenting a first end and a second end;

a first receptacle positioned in said housing proximate the first end;

a first quantity of solid paint carried by the first receptacle and extending longitudinally beyond the first end;

an actuator for longitudinally shifting the first receptacle within and relative to the housing;

a second receptacle positioned in said housing proximate the second end; and a second quantity of solid paint carried by the second receptacle and extending longitudinally beyond the second end, wherein said first receptacle is removably mounted in a first receiver of a pusher element operatively coupled to said actuator and configured for removal and replacement without the need for tools, wherein said first receptacle includes tabs flexibly mounted on said receptacle, said tabs including ribs complementally sized and configured for mating engagement with respective grooves in said first receiver.

15. An apparatus as set forth in claim 14, wherein the housing includes a first housing section including the first end and a second housing section including the second end connected to the first housing section by a snap-fit connection.

16. A system for applying solid paint to skin, the system comprising:

a first receptacle containing a first quantity of solid paint;

a second receptacle containing a second quantity of solid paint;

a third receptacle containing a third quantity of solid paint; and a housing having— a first end and a second end, with each end of the housing operable to receive one of the first, second, and third receptacles; and an actuator for longitudinally shifting at least one of the receptacles relative to the housing, such that the portion of solid paint associated with the at least one of the receptacles is operable to be extended from and retracted within the first end of the housing, wherein the first receptacle is received in the first end of the housing and the second receptacle is received in the second end of the housing, and wherein the third receptacle is interchangeable with at least one of the first receptacle and the second receptacle, such that the third receptacle is configured to be positioned within at least one of the first end and the second end of the housing.

17. The system as set forth in claim 16, wherein each of the first, second, and third receptacles at least partially encloses the first, second, and third quantity of solid paint, respectively, and wherein each of the first, second, and third quantity of solid paint is at least partially unenclosed by the first, second, and third receptacles, respectively.

18. A system for applying solid paint to skin, the system comprising:

a first receptacle containing a first quantity of solid paint;

a second receptacle containing a second quantity of solid paint;

a third receptacle containing a third quantity of solid paint; and a housing having— a first end and a second end, with each end of the housing operable to receive one of the first, second, and third receptacles; and an actuator for longitudinally shifting at least one of the receptacles relative to the housing, such that the portion of solid paint associated with the at least one of the receptacles is operable to be extended from and retracted within the first end of the housing, wherein the first, second, and third receptacles are each operable to be mounted within a receiver associated with the actuator, such that when the first, second, or third receptacles are mounted within the receiver, movement of the actuator relative to the housing produces a corresponding movement of the receiver so as to longitudinally move the first, second, or third receptacle and the first, second, or third quantity of solid paint, respectively, relative to the housing.

19. The system as set forth in claim 18, wherein the first, second, and third receptacles are each configured to be selectively disposed with the receiver.

20. A system for applying solid paint to skin, the system comprising:

a first receptacle containing a first quantity of solid paint;

a second receptacle containing a second quantity of solid paint;

a third receptacle containing a third quantity of solid paint; and a housing having— a first end and a second end, with each end of the housing operable to receive one of the first, second, and third receptacles; and an actuator for longitudinally shifting at least one of the receptacles relative to the housing, such that the portion of solid paint associated with the at least one of the receptacles is operable to be extended from and retracted within the first end of the housing, wherein the first, second, and third receptacles are operable to be removably mounted in a receiver operatively coupled to the actuator and configured for removal and replacement without the need for tools.

* * * * *